US009098989B2

(12) United States Patent
Fischer

(10) Patent No.: US 9,098,989 B2
(45) Date of Patent: Aug. 4, 2015

(54) EVALUATION OF SCATTERED-LIGHT SIGNALS IN AN OPTICAL HAZARD ALARM AND OUTPUT BOTH OF A WEIGHTED SMOKE DENSITY SIGNAL AND ALSO OF A WEIGHTED DUST/STEAM DENSITY SIGNAL

(71) Applicant: SIEMENS AKTIENGESELLSCHAFT, Munich (DE)

(72) Inventor: Martin Fischer, Buelach (CH)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 13/876,686

(22) PCT Filed: Sep. 25, 2012

(86) PCT No.: PCT/EP2012/068875
§ 371 (c)(1),
(2) Date: Mar. 28, 2013

(87) PCT Pub. No.: WO2013/045446
PCT Pub. Date: Apr. 4, 2013

(65) Prior Publication Data

US 2014/0197957 A1 Jul. 17, 2014

(30) Foreign Application Priority Data

Sep. 30, 2011 (DE) ..... 10 2011 083 939

(51) Int. Cl.
*G08B 17/107* (2006.01)

(52) U.S. Cl.
CPC ..... *G08B 17/107* (2013.01)

(58) Field of Classification Search
CPC ..... G08B 17/107; G08B 17/103; G01N 15/0205; G01N 21/53; G01N 21/532
See application file for complete search history.

(56) References Cited

U.S. PATENT DOCUMENTS 5,477,218 A * 12/1995 Manmoto et al. ..... 340/630
6,011,478 A 1/2000 Suzuki et al.

(Continued)

FOREIGN PATENT DOCUMENTS

CN 1987426 A 6/2007
CN 101036173 A 9/2007

(Continued)

OTHER PUBLICATIONS

Qiyuan Xie et al., "Characteristics of light scattering by smoke particles based on spheroid models," Journal of Quantitative Spectroscopy and Radiative Transfer, vol. 107, Issue 1, Sep. 2007, pp. 72-82.

(Continued)

*Primary Examiner* — Benjamin C Lee
*Assistant Examiner* — Rajsheed Black-Childress
(74) *Attorney, Agent, or Firm* — Staas & Halsey LLP

(57) ABSTRACT

A method evaluates two scattered-light signals in a hazard alarm operating in accordance with the scattered light principle. The particles to be detected are irradiated with light in a first wavelength range and with light in a second wavelength range. The light scattered by the particles is converted into a first and second non-normalized scattered light signal. The two scattered light signals are normalized in relation to one another such that their amplitude curve approximately coincides for larger particles such as dust and steam. The two normalized scattered light signals are transformed into a polar angle and a distance as polar coordinates of a polar coordinate system. Finally a respective smoke density signal and a respective dust/steam density signal is formed from a current distance value, wherein for this purpose the respective current distance values, depending on a current polar angle value, are weighted in opposition to one another.

13 Claims, 3 Drawing Sheets

(56) References Cited

U.S. PATENT DOCUMENTS

| | | | | |
|---|---|---|---|---|
| 6,218,950 | B1 * | 4/2001 | Politze et al. | 340/630 |
| 7,075,646 | B2 * | 7/2006 | Cole | 356/338 |
| 7,084,401 | B2 | 8/2006 | Bell et al. | |
| 7,738,098 | B2 | 6/2010 | Cole | |
| 7,777,634 | B2 | 8/2010 | Kaelin et al. | |
| 8,269,639 | B2 | 9/2012 | Cole | |
| 8,546,740 | B2 | 10/2013 | Vollenweider | |
| 8,890,700 | B2 * | 11/2014 | Cole | 340/630 |
| 2005/0057365 | A1 | 3/2005 | Qualey, III | |
| 2008/0117407 | A1 | 5/2008 | Albers et al. | |
| 2011/0221889 | A1 | 9/2011 | Knox et al. | |
| 2013/0234856 | A1 * | 9/2013 | Cole | 340/630 |

FOREIGN PATENT DOCUMENTS

| | | | |
|---|---|---|---|
| CN | 101515400 | A | 8/2009 |
| CN | 102112867 | A | 6/2011 |
| DE | 60205127 | | 5/2006 |
| EP | 0877345 | | 11/1998 |
| EP | 0 977 345 | A2 | 2/2000 |
| RU | 2344859 | C2 | 1/2009 |
| RU | 2008 107 740 | A | 9/2009 |
| WO | WO 2007/014598 | A1 | 2/2007 |
| WO | 2008/064396 | | 6/2008 |

OTHER PUBLICATIONS

International Search Report for PCT/EP2012/068875, mailed Dec. 12, 2012, 3 pages.

Copy of PCT Published Application WO 2013/045445, published on Apr. 4, 2013, 32 pages.

Decision to Grant mailed Jul. 29, 2014 for corresponding Russian Application No. 2013113969/08(020634) with German translation.

Qiyuan Xie et al., "Characteristics of light scattering by smoke particles based on spheroid models," Journal of Quantitative Spectroscopy and Radiative Transfer, vol. 107, Issue 1, Sep. 2007, Abstract only, 3 pages.

PCT/EP2012/068875, filed Sep. 25, 2012, Martin Fischer, Siemens AG.

DE 102011083939.9, filed Sep. 30, 2011, Martin Fischer, Siemens AG.

* cited by examiner

EVALUATION OF SCATTERED-LIGHT SIGNALS IN AN OPTICAL HAZARD ALARM AND OUTPUT BOTH OF A WEIGHTED SMOKE DENSITY SIGNAL AND ALSO OF A WEIGHTED DUST/STEAM DENSITY SIGNAL

CROSS REFERENCE TO RELATED APPLICATIONS

This application is based on and hereby claims priority to International Application No. PCT/EP2012/068875 filed on Sep. 25, 2012 and German Application No. 10 2011 083 939.9 filed on Sep. 30, 2011, the contents of which are hereby incorporated by reference.

BACKGROUND

The invention relates to a method for evaluating two scattered-light signals in an optical hazard alarm operating in accordance with the scattered light principle.

The invention further relates to an optical hazard alarm with a detection unit operating in accordance with the scattered light principle.

Furthermore it is generally known that particles with a size of larger than 1 μm predominantly involve dust, while particles with a size of smaller than 1 μm predominantly involve smoke.

Such a method or such a hazard alarm is known from international publication WO 2008/064396 A1. In the publication it is proposed, for increasing the sensitivity for the detection of smoke particles, that only the second scattered light signal with blue light wavelength is evaluated if the amplitude ratio corresponds to a particle size of less than 1 μm. If on the other hand the amplitude ratio corresponds to a particle size of more than 1 μm, the difference is formed between the second scattered light signal with blue light wavelength and the first scattered light with infrared light wavelength. Through the differentiation the influence of dust is suppressed and thus the triggering of a false alarm for the presence of a fire is largely suppressed.

U.S. Pat. No. 7,738,098 B2 likewise discloses a method and also an optical hazard alarm for evaluation of two scattered light signals. The particles to be detected, present in a fluid are irradiated with light in a first wavelength range, such as e.g. in the blue wavelength range, and with light in a second wavelength range, such as in the red or infrared range for example. The two scattered light signals are subsequently normalized in relation to one another such that their amplitude curve roughly coincides for larger particles such as dust and steam, such as to Portland cement as a dust substitute for example.

SUMMARY

One possible object is to specify an expanded evaluation method of scattered light signals and also an improved optical hazard alarm.

In the method proposed by the inventor the particles to be detected are irradiated with light in a first wavelength range and with light in a second wavelength range. The light scattered by the particles is converted into a first and second scattered light signal. The two scattered light signals are normalized in relation to one another in a manner such that their amplitude curve roughly coincides for larger particles such as dust and steam. The two normalized scattered light signals can then be further evaluated in respect of characteristic fire values. The two normalized scattered light signals are also each transformed into a polar angle and a distance, as polar coordinates of a polar coordinate system. A smoke density signal and a dust/steam density signal are formed in each case from the current distance value, depending on a current polar angle value, running against each other or weighted in opposition to each other. Finally the weighted smoke density signal and the weighted dust/steam density signal are output for (possible) further evaluation of characteristic fire values.

A basic idea of the proposal is that, along with the output of a smoke density signal for possible further processing, in addition a dust/steam density signal is output for possible further processing. This signal can for example provide information about whether an impermissibly high dust density and/or (water) steam density is present. A dust density that is too high can represent a high safety risk and for example accelerate the spread of a fire or promote flash fires or explosions. Equally a steam density or water vapor density that is too high can be an indication of a hot water leak such as in a heating system for example. The additional dust/steam density signal can thus advantageously deliver further information, especially in combination with the smoke density signal, in relation to an area to be monitored.

The output of two separate signals for the presence of smoke and for the presence of dust or steam makes it possible to further process the signals separately without having to suppress one of the two signals. On the other hand the ratio of the first normalized scattered light signal to the second normalized scattered light signal cannot be measured precisely ranging over all tolerances. One reason for this is compensation tolerances during the manufacturing of hazard alarms, ageing of components and contamination of the optical part, which influence or change the scattered light detection. The output of the two separate signals for smoke and dust/steam further makes possible a very high sensitivity for the smoke detection and at the same time a low sensitivity for the presence of dust or steam, wherein the latter will not be completely suppressed.

In accordance with a first variant of the method the current distance value in the formation of the smoke density signal is degressively weighted for increasing polar angle values. The current distance value, especially the same current distance value is progressively weighted in the formation of the dust/steam density signal for increasing polar angle values. This applies to the case in which the polar angle is formed from the ratio or the quotient between first and second normalized scattered light signal.

As an alternative, for the converse case that the polar angle is formed from the ratio or the quotient between second and first normalized scattered light signal, the current distance value is progressively weighted in the formation of the smoke density signal for increasing polar angle values. The current distance value, especially the same current distance value, is degressively weighted in the formation of the dust/steam density signal for increasing polar angle values.

The reversal of the ratio or quotient formation, from which the polar angle is formed via the arctangent function, corresponds in this case to the formation of the polar angle of the same ratio or quotient formation by the arctangent function. The polar angle values for the second case correspond to polar angle values which are produced from 90° or $\pi/2$ minus the first polar angle values.

Degressive weighting in particular means a monotonously reducing weighting, e.g. on the basis of an inverse proportional function, a linear function with negative gradient, an exponential function with negative exponents etc.

Progressive weighting especially means a monotonously increasing weighting, e.g. on the basis of a quadratic function, an exponential function, a linear function with positive gradient etc.

In accordance with a variant of the method the particles are irradiated with infrared light of a wavelength of between 600 and 1000 nm, especially with a wavelength of 940 nm±20 nm, and with blue light of a wavelength of between 450 and 500 nm, especially with a wavelength of 470 nm±20 nm. The light can originate from a single light source for example, which transmits infrared light and blue light alternating over time. It can also stem from two separate light sources, especially from a blue light emitting diode and from an infrared light emitting diode. Especially advantageous in such cases is the use of a light emitting diode with a wavelength at 940 nm±20 nm and also of a blue light emitting diode with a wavelength at 470 nm±20 nm.

This makes a robust evaluation of the received red and blue light possible. Also, assuming that environmental influences and component/compensation tolerances change the response behavior, the result is not a complete suppression of one of the two red or blue scattered light signals. In other words the sensitivity of the hazard detector becomes lower through the degressive weighting with an increasing red proportion, however a degree of residual sensitivity is always retained. The hazard alarm will consequently always "go into alarm mode" for high aerosol concentrations, even if it does so with very reduced sensitivity for dust.

Preferably the pre-determinable particle size has a value in the range of between 0.5 and 1.1 μm, especially a value of around 1 μm. In accordance with a further variant of the method the amplitude comparison value is set to a value ranging between 0.8 and 0.95, especially to a value of 0.9, or to its reciprocal value. A value of 0.9 approximately corresponds in such cases to a particle size of 1 μm.

The inventor also proposed an optical hazard alarm having a detection unit and an electronic evaluation unit connected thereto. The detection unit has at least one light source for irradiation of particles to be detected and at least one optical receiver for detection of the light scattered by the particles. The light emitted by the at least one light source lies at least in a first wavelength range and in a second wavelength range. The at least one optical receiver is sensitive to the first and/or second wavelength range and also embodied for converting the received scattered light into a first and a second scattered light signal. The evaluation unit normalizes the two scattered light signals such that their amplitude curve approximately coincides for larger particles such as dust and steam. It is also configured to evaluate the two normalized scattered light signals in respect of characteristic fire variables. According to the proposal, the electronic evaluation unit has a second unit for computer transformation of the two normalized scattered light signals into a polar angle and a distance in each case as polar coordinates of a polar coordinate system. The electronic evaluation unit further has a third unit for determining a smoke density signal and a dust/steam density signal in each case from the current distance value, wherein the third unit for this purpose weights the respective current distance value, depending on a current polar angle value, in opposition to one another and wherein the third unit outputs the weighted smoke density signal and the weighted dust/steam density signal for possible further evaluation in respect of characteristic fire variables.

In accordance with an embodiment the third unit weights the current distance value degressively during the formation of the smoke density signal for increasing polar angle values, i.e. decreasing monotonously, such as for example inversely proportional, linearly with a negative gradient etc. Furthermore the third unit weights the distance value for the formation of the dust/steam density signal for increasing polar values, i.e. monotonously increasing, such as for example quadratically, exponentially linearly with a positive gradient etc. This applies in the case in which the second unit forms the polar angle from the ratio between first and second normalized scattered light signal.

In accordance with an alternative embodiment to this the third unit weights the current distance value during the formation of the smoke density signal for increasing polar angle values progressively i.e. monotonously increasing, such as for example quadratic, exponentially, linearly with a positive gradient etc. Furthermore the third unit weights the current distance value in the formation of the dust/steam density signal for increasing polar angle values degressively, i.e. monotonously decreasing, such as for example inversely proportionally, linearly with negative gradient etc. This applies to the other case in which the second unit forms the polar angle from the ratio of second to first normalized scattered light signal.

The electronic evaluation unit can be an analog and/or digital electronic circuit, which e.g. features A/D converters, amplifiers, comparators, operational amplifiers for the normalization of the scattered light signals etc. In the simplest case this evaluation unit is a microcontroller, i.e. a processor-based electronic processing unit, which is usually present "in any event" for overall control of the hazard alarm. The operations of the evaluation unit is preferably emulated by program steps which are executed by the microcontroller, if necessary also with the inclusion of electronically stored table values e.g. for the comparison values and signal thresholds. A corresponding computer program can be stored in a non-volatile memory of the microcontroller. As an alternative it can be loaded from an external memory. Furthermore the microcontroller can feature one or more integrated A/D converters for recording the measured values of the two scattered light signals. It can for example also feature D/A converters, via which the radiation intensity of at least one of the two light sources can be set for normalizing the two scattered light signals.

The second unit can for example be realized as a computer program which converts the two axes of a Cartesian coordinate system, i.e. the first and second normalized scattered light signal, into a polar angle and a distance by a polar transformation. The second unit can also be realized as a table or as a matrix, which are stored in a memory of the electronic evaluation unit. In this table or matrix an assigned distance value and an assigned polar angle value can be stored for each Cartesian coordinate, i.e. for each first and second scattered light signal value.

The third unit can likewise be realized as a computer program which, on the basis of the two polar coordinate values, i.e. the respective distance values and polar angle values, converts the respective distance value via a corresponding weighting function depending on the respective polar angle value, into a smoke density signal value or a dust/steam density signal value, Preferably the second and third units are stored as electronic tables or matrices in the evaluation unit, which assigns a weighted smoke density signal value and a weighted dust/steam density signal value in each case to a current first and second normalized scattered light signal value as Cartesian coordinates. Both the Cartesian/polar transformation as well is the inverse weighting of the respective distance value in the form of an assigned numerical value is already realized in these tables.

In accordance with an embodiment the detection unit has an infrared light emitting diode with a wavelength in the first wavelength range of between 600 and 1000 nm, especially with a wavelength of 940 nm±20 nm, a blue light emitting diode with a wavelength in the second wavelength range of between 450 and 500 nm, especially with a wavelength of 470 nm±20 nm.

Preferably the pre-determinable particle size has a value in the range between 0.5 and 1.1 μm, especially a value of approximately 1 μm.

In accordance with a further embodiment the electronic evaluation unit has a fourth unit for comparing the weighted smoke density signal with at least one smoke density signal threshold and also a signaling unit for signaling at least one fire alarms stage, such as three fire alarm stages for example. The respective fire alarm stage can be output on optical paths and/or acoustic paths. As an alternative or in addition it can be output by wire and/or wirelessly to a fire alarm center.

In accordance with a further embodiment the electronic evaluation unit has a fifth unit for comparing the weighted dust/steam density signal with a least one dust/steam signal threshold and as well as a signaling unit for signaling at least one dust/steam alarm stage, such as three dust/steam alarm stages for example. The respective dust/steam alarm stage can likewise be output on optical paths and/or acoustic paths. As an alternative or in addition it can be output by wire and/or wirelessly to a fire alarm center.

Also the hazard alarm is preferably a fire alarm or a smoke alarm, or an aspirating smoke detector with a connectable pipe system for monitoring the air sucked in from rooms and devices requiring monitoring.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
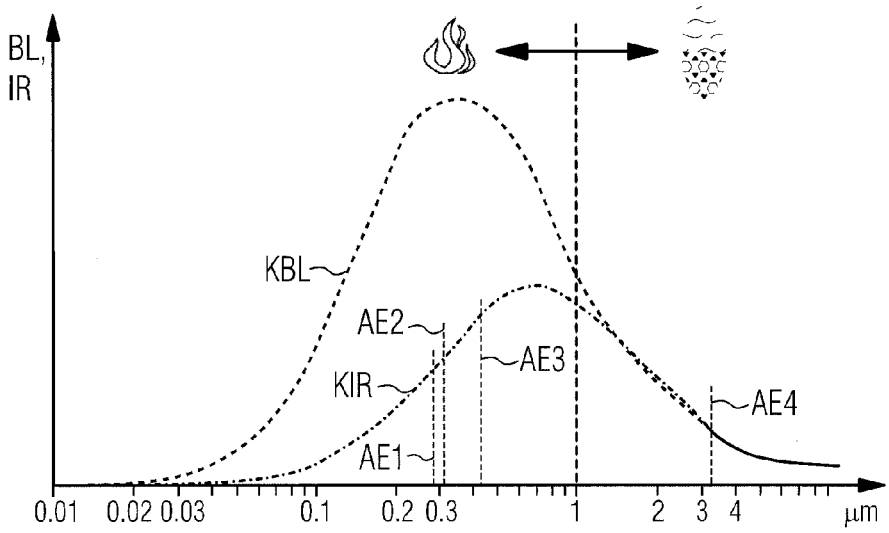
FIG. 1 shows the relative signal level in each case of an amplitude curve of for example infrared and blue scattered light, plotted logarithmically in μm and with an illustration of the average particle size of typical smoke and dust particles.

Reference will now be made in detail to the preferred embodiments of the present invention, examples of which are illustrated in the accompanying drawings, wherein like reference numerals refer to like elements throughout.

FIG. 1 shows the respective relative signal level BL, IR of an amplitude curve KIR, KBL of for example infrared and blue scattered light, plotted logarithmically in μm and with an illustration of average particle sizes for the typical smoke and dust particles AE1-AE4 (aerosols).

AE1 plots the average smoke particle size for burning wool at appr. 0.28 μm, AE2 the smoke particle size for a burning wick at appr. 0.31 μm, AE3 the smoke particle size for burnt toast at appr. 0.42 μm and AE3 the average dust particle size for Portland cement at appr. 3.2 μm. Also entered in the figure is a dashed line at 1 μm, which represents an empirical boundary between smoke and dust/steam for typical particles to be expected. It can—depending on the environment to be supervised—also be defined to range between 0.5 and 1.1 μm.

KIR refers to the amplitude curve of the infrared scattered light signal IR with a wavelength of 940 nm and KBL refers to the amplitude curve of the blue scattered light signal BL with a wavelength of 470 nm. The two scattered light signals BL, IR, in the diagram shown, are already normalized in relation to one another, such that their amplitude curve for larger particles such as dust and steam approximately matches. In the present example the amplitude curve approximately matches for a particle size of more than 3 μm.

As FIG. 1 shows, the blue light is scattered more at smaller particles and the infrared light is scattered more at larger particles.

Figure 2:
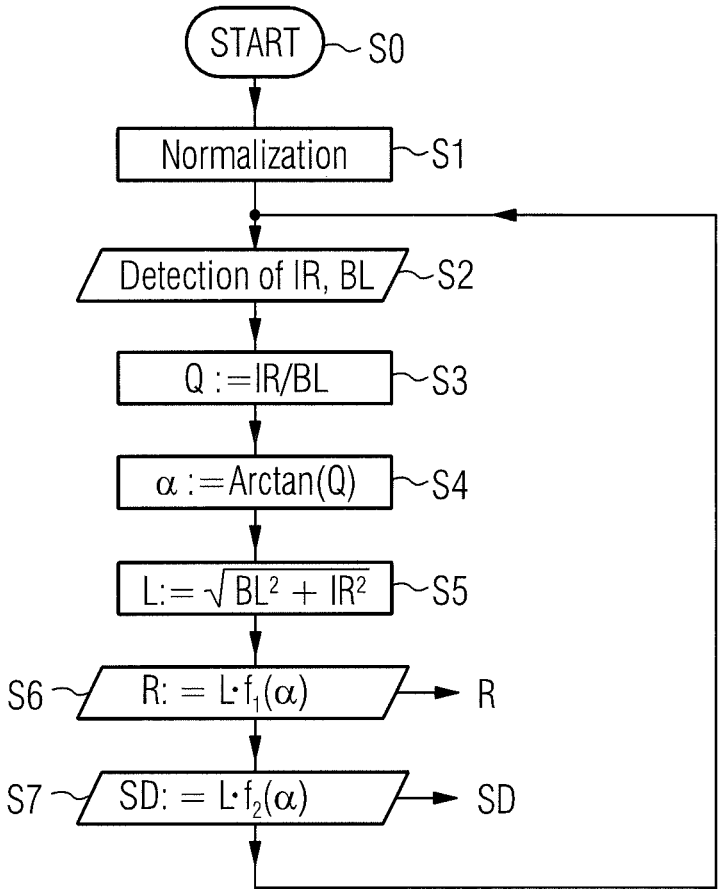
FIG. 2 shows a typical flowchart in accordance with a variant of the method for explaining the proposed method.

FIG. 2 shows a typical flowchart already in accordance with a variant of the method for explaining the proposed method. The individual steps S1-S7 can be emulated by suitable program steps of a computer program and be executed on a processor-based processing unit of a hazard alarm, such as on a microcontroller for example.

S0 designates a start step. In this initialization step the particle size can be predetermined for example.

In step S1 the two scattered light signals IR', BL' are normalized in relation to one another such that their amplitude curve approximately coincides for larger particles such as dust and steam. This calibration process is preferably repeated cyclically as part of the commissioning of a hazard alarm and where necessary later.

In typical normal operation of the hazard alarm, in step S2, the light scattered from the particles is converted into the first and second normalized scattered light signal IR, BR and is thus detected.

In step S3 the quotient Q or the ratio between the two scattered light signals IR, BL is formed. In the present case the ratio IR:BL is typically formed. As an alternative the reciprocal value of the two scattered light signals BL, IR can also be formed.

In step S4, as a first part of the polar coordinate transformation, a respective polar angle value $\alpha$ is established computationally via the arctangent function from the previously determined quotients Q.

In step S5, as a second part of the polar coordinate transformation, a respective distance value L is established computationally via the root formation from the sum of the squares of the two scattered light signal values.

In step S6 a smoke density signal value R is established and output by the established distance value L being weighted by a first degressive weighting function f1, depending on the established polar angle value $\alpha$.

In step S7 a dust/steam density signal value SD is established and output by the distance value L established being progressively weighted by the second progressive weighting function f2, depending on the established polar angle value $\alpha$.

The program subsequently branches back to step S2.

Figure 3:
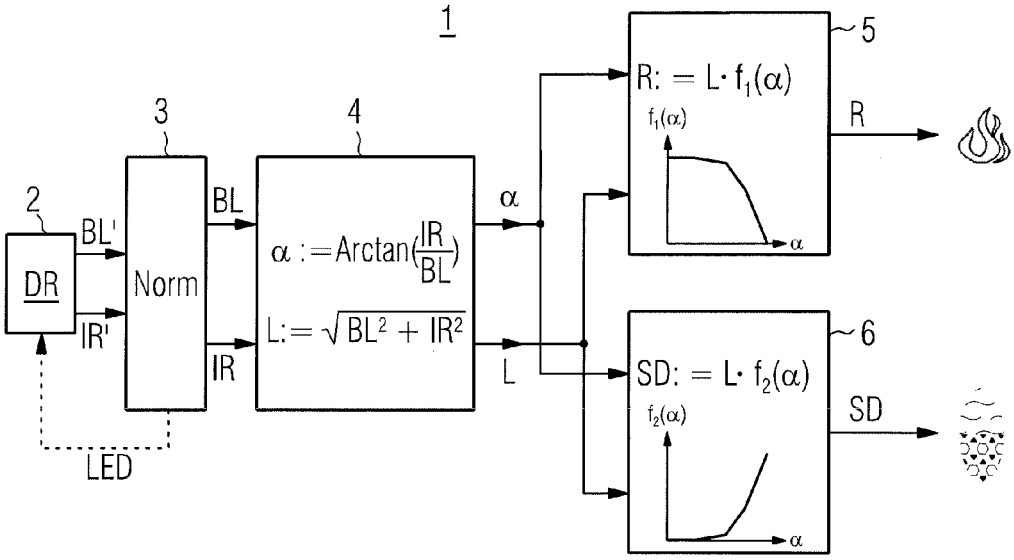
FIG. 3 shows a functional principle of a proposed hazard alarm in accordance with an embodiment and FIG. 4 shows an example for a first matrix, by which normalized red and blue scattered light signal values are mapped into a weighted smoke density signal value.

FIG. 3 shows an example for a proposed hazard alarm 1 in accordance with a first embodiment.

The optical hazard alarm 1 is especially a fire alarm or smoke alarm. It can also be embodied as a point alarm. It can also be an aspirating smoke detector with a tubular system able to be connected thereto for monitoring the air sucked in from rooms and devices in need of monitoring. Furthermore the hazard alarm has a detection unit 2 operating on the scattered light principle. The latter can for example be disposed in an enclosed measurement chamber with a detection space DR located therein. In this case the fire alarm or smoke alarm 1 is a closed fire alarm or smoke alarm. As an alternative or in addition the fire alarm or smoke alarm 1 can be what is referred to as an open fire alarm or smoke alarm, having a detection space DR lying outside the detection unit 2.

The detection unit 2 has at least one light source not shown in any greater detail for irradiating particles to be detected in the detection space DR as well as at least one optical receiver for detection of light scattered by the particles. Preferably the detection unit has an infrared light emitting diode with a wavelength in a first wavelength range of between 600 and 1000 nm, especially with a wavelength of 940 nm±20 nm, and a blue light emitting diode with a wavelength in a second wavelength range of between 450 and 500 nm, especially with a wavelength of 470 nm±20 nm as light sources. Furthermore the detection unit 2 has at least one optical receiver which is sensitive to the first and/or second wavelength range and is embodied for converting the received scattered light into a first and second (non-normalized) scattered light signal BL', IR'. Preferably such an optical receiver is a photodiode or a phototransistor. The two scattered light signals BL', IR' can also be formed offset in time by a single sensitive optical receiver for both wavelength ranges. In this case the particles are alternately preferably irradiated with blue light and infrared light and the first and second scattered light signal BL', IR' are formed synchronized to this.

Furthermore the hazard alarm 1 has an evaluation unit connected to the detection unit 2 for transmission of signals or data with a number of electronic unit(s). The first unit 3 is provided for normalizing the two (non-normalized) scattered light signals IR', BL' to one another, so that their amplitude curve approximately coincides for larger particles such as dust and steam. This first unit 3 can have adjustable amplifiers or attenuation elements for example, in order to normalize the signal level of the two scattered light signals IR', BL' to one another. It can also provide one or two output signal LEDs in order to set the respective light intensity of the two light sources in the detection unit 2 so that the amplitude curve of the two scattered light signals IR', BL' approximately coincides again for larger particles such as dust and steam. IR, BL ultimately designate the two normalized scattered light signals.

The evaluation unit also has two units 4 for polar coordinate transformation of a first and a second normalized scattered light value IR, BL in each case into a distance and polar angle value L, a respectively. The transformation can be undertaken for example on the basis of mathematical functions realized in software.

In the right-hand part of FIG. 3 the respective opposing weighting of the respective output state value L is undertaken by a first and second weighting function dependent in each case on the currently established polar angle value α (third units 5,6).

Preferably all components of the evaluation unit shown in FIG. 3 are realized by a processor-based processing unit such as a microcontroller for example. The latter preferably has integrated A/D converters for detecting the two scattered light signals IR', BL' as well as D/A converters and/or digital output ports for the output of the smoke density signal R and of the dust/steam signal SD. The operations of the evaluation unit are preferably emulated by suitable program steps, which are then executed on the microcontroller.

Figure 4:
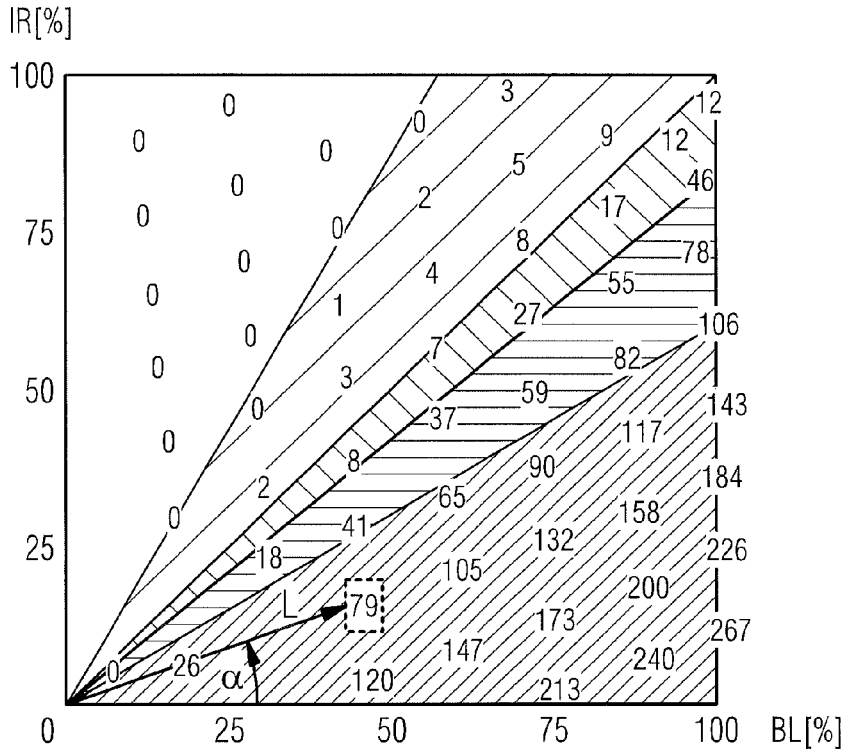

FIG. 4 shows an example for a first matrix by which normalized red and blue scattered light signals are mapped into a weighted smoke density signal value. The matrix shown is for example a table stored electronically in a memory of the evaluation unit. The values shown cover a range of numerical values from 0 to 252. They can consequently be mapped by one data byte in the table. The two normalized first and second scattered light signals or the two normalized red and blue signals IR, BL are also each normalized to a maximum value of 100%. In addition lines emerging in the shape of rays from the origin can typically be seen, which divide the matrix into five triangles for example which are each assigned a smoke density level. The lines emerging from the origin can also be seen as smoke signal thresholds. Smoke density levels with high numerical values, such as for example the right lower triangle with values from 26 to 246, correspond to a highest smoke density level five, which is typically to be equated with a fire alarm. The left upper triangle only has numerical values of 0. This corresponds to the lowest smoke density level, i.e. to "no small smoke particles detected" or to "OK". Smoke density levels lying between the two correspond to corresponding early or preliminary warning stages.

The red and blue signals IR, BL are mapped into a polar coordinate L, α represented as a vector. In this case the numerical values or the smoke density signal values generally increase as the distance L increases. At the same time the values decrease in the direction of rotation α as the value of α increases. This corresponds to the degressive weighting here. In other words the values, for the same vector length or the same distance value L, which approximately corresponds to the same number of detected particles, become all the larger, the smaller of the polar angle α or the more "blue" light and consequently the more small smoke particles have been detected.

Figure 5:
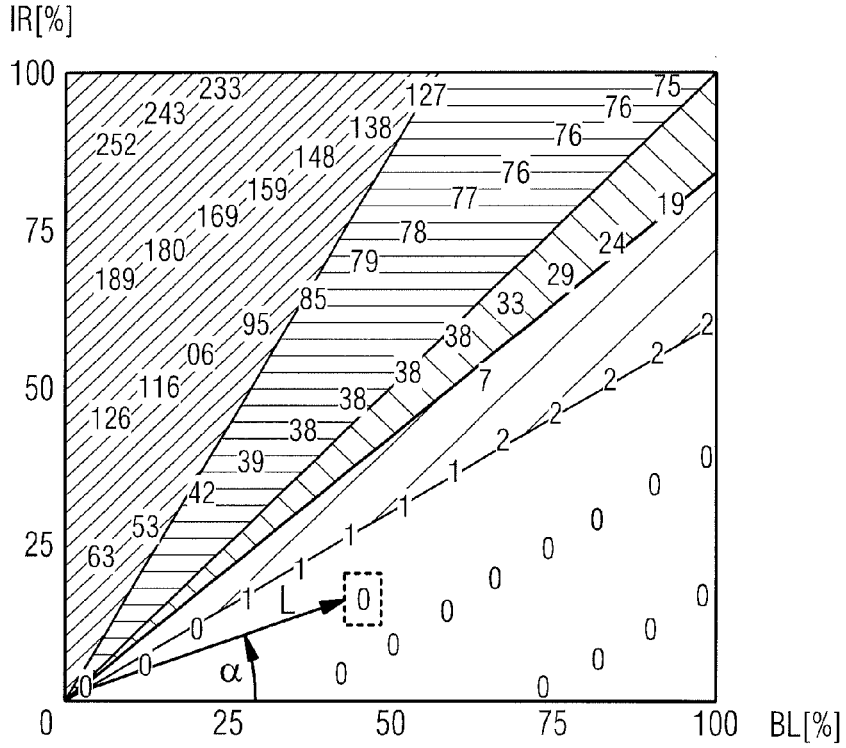
FIG. 5 shows an example for a second matrix, by which normalized red and blue scattered light signal values are mapped into a weighted dust/steam density signal value.

FIG. 5 shows an example for a second matrix by which normalized red and blue scattered light signal values are mapped into a weighted dust/steam density signal value.

Once again lines emerging from the origin in the form of rays can be seen, which divide the matrix for example into five triangles, which are each assigned a dust/steam density level. The lines emerging from the origin can also be seen as dust/steam signal thresholds. Dust/steam density levels with high numerical values, such as for example the left upper triangle with values of 53 to 252, correspond to a highest dust/steam density level of five, which is typically to be equated with a dust/steam warning. The right lower triangle on the other hand only has numerical values of 0. This corresponds to the lowest dust/steam density level, i.e. to "no large particles detected" or to "OK". Dust/steam density levels lying between the two correspond to corresponding early or preliminary warning stages.

The red and blue signals IR, BL are mapped into a polar coordinate L, a represented as a vector. In this case the numerical values or the dust/steam density signal values generally increase as the distance L increases. At the same time the values decrease in the direction of rotation α as the value of a increases. This corresponds to the progressive weighting here. In other words the values, for the same vector length or for the same distance value L, which approximately corresponds to the same number of detected particles, become all the larger, the larger the polar angle α or the more "red" light and consequently the more large dust/steam particles have been detected.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in Superguide v. DIRECTV, 69 USPQ2d 1865 (Fed. Cir. 2004).

The invention claimed is:

1. A method for evaluating two scattered light signals in a hazard alarm operating in accordance with a scattered light principle, the method comprising:

irradiating particles to be detected with a first light in a first wavelength range and with a second light in a second wavelength range;

converting light scattered by the particles into respective first and second non-normalized signals correspondingly from said first and second lights, respectively;

normalizing the first and second non-normalized signals to one another and producing two normalized scattered light signals having amplitude curves that approximately coincide for dust- and steam-sized particles;

transforming the two normalized scattered light signals as a ratio into a polar angle and a polar distance as polar coordinates of a polar coordinate system;

forming a weighted smoke density signal and a weighted dust/steam density signal by weighting the polar distance depending on the polar angle, the polar distance being weighted oppositely in forming the weighted smoke density signal and the weighted dust/steam density signal; and outputting the weighted smoke density signal and the weighted dust/steam density signal for further evaluation of the hazard alarm.

2. The method as claimed in claim 1, wherein the weighted smoke density signal is compared in a smoke comparison with a smoke signal threshold and a fire alarm stage is signaled based on the smoke comparison, and/or the weighted dust/steam density signal is compared in a dust/steam comparison with a dust/steam signal threshold and a dust/steam warning stage is signaled based on the dust/steam comparison.

3. The method as claimed in claim 1, wherein if the polar angle is formed from as a quotient between first and second normalized scattered light signals, then:

the polar distance is weighted degressively during formation of the weighted smoke density signal for increasing polar angle values, and the polar distance value is weighted progressively during formation of the weighted dust/steam density signal for increasing polar angle values, and if the polar angle is formed from as a quotient between second and first normalized scattered light signals, then:

the polar distance is weighted progressively during formation of the weighted smoke density signal for increasing polar angle values, and the polar distance is weighted degressively during formation of the weighted dust/steam signal for increasing polar angle values.

4. The method as claimed in claim 1, wherein the first light is infrared light and the first wavelength range is between 600 and 1000 nm, and the second light is blue light and the second wavelength range is between 450 and 500 nm.

5. The method as claimed in claim 1, wherein the first light is infrared light and the first wavelength range is 940 nm±20 nm, and the second light is blue light and the second wavelength range is 470 nm±20 nm.

6. The method as claimed in claim 1, wherein the first and second non-normalized signals are normalized to amplitude curves that approximately coincide for particles having a particle size 0.5 and 1.1 μm.

7. An optical hazard alarm operating in accordance with a scattered light principle, comprising:

a detection device comprising:

at least one light source to irradiate particles to be detected with a first light in a first wavelength range and with a second light in a second wavelength range; and an optical receiver to convert light scattered by the particles into respective first and second non-normalized signals correspondingly from said first and second lights, respectively; and an electronic evaluation unit comprising:

a normalization unit to normalize the first and second non-normalized signals to one another and produce two normalized scattered light signals having amplitude curves that approximately coincide for dust- and steam-sized particles;

a processor to transform the two normalized scattered light signals as a ratio into a polar angle and a polar distance as polar coordinates of a polar coordinate system; and a signal formation unit to form a weighted smoke density signal and a weighted dust/steam density signal by weighting the polar distance depending on the polar angle, the polar distance being weighted oppositely in forming the weighted smoke density signal and the weighted dust/steam density signal, the weighted smoke density signal and the weighted dust/steam density signal being output for further evaluation of the hazard alarm.

8. An optical hazard alarm as claimed in claim 7, wherein if the polar angle is formed from as a quotient between first and second normalized scattered light signals, then:

the polar distance is weighted degressively during formation of the weighted smoke density signal for increasing polar angle values, and the polar distance value is weighted progressively during formation of the weighted dust/steam density signal for increasing polar angle values, and if the polar angle is formed from as a quotient between second and first normalized scattered light signals, then:

the polar distance is weighted progressively during formation of the weighted smoke density signal for increasing polar angle values, and the polar distance is weighted degressively during formation of the weighted dust/steam signal for increasing polar angle values.

9. The optical hazard alarm as claimed in claim 7, wherein the first light is infrared light and the first wavelength range is between 600 and 1000 nm, and the second light is blue light and the second wavelength range is between 450 and 500 nm.

10. The optical hazard alarm as claimed in claim 7, wherein the first light is infrared light and the first wavelength range is 940 nm±20 nm, and the second light is blue light and the second wavelength range is 470 nm±20 nm.

11. The optical hazard alarm as claimed in claim 7, wherein the first and second non-normalized signals are normalized to amplitude curves that approximately coincide for particles having a particle size 0.5 and 1.1 μm.

12. The optical hazard alarm as claimed in claim 7, wherein the electronic evaluation unit has:

a comparison unit to compare the weighted smoke density signal with a smoke signal threshold; and a signaling unit to signal a smoke alarm stage based on the comparison.

13. The optical hazard alarm as claimed in claim 7, wherein the electronic evaluation unit has:

a comparison unit to compare the weighted dust/steam density signal with a dust/steam signal threshold; and a signaling unit to signal a dust/steam warning stage based on the comparison.

* * * * *